US010456826B2

(12) United States Patent
Kho

(10) Patent No.: US 10,456,826 B2
(45) Date of Patent: Oct. 29, 2019

(54) TAPE FEED APPARATUS AND METHOD FOR A SELF-PIERCING RIVET MACHINE

(71) Applicant: Newfrey LLC, New Britain, CT (US)

(72) Inventor: Chuan Meng Kho, Troy, MI (US)

(73) Assignee: Newfrey LLC, New Britain, CT (US)

( * ) Notice: Subject to any disclaimer, the term of this patent is extended or adjusted under 35 U.S.C. 154(b) by 0 days.

(21) Appl. No.: 15/901,236

(22) Filed: Feb. 21, 2018

(65) Prior Publication Data

US 2019/0255595 A1 Aug. 22, 2019

(51) Int. Cl.
*B21J 15/32* (2006.01)
*B21J 15/02* (2006.01)

(52) U.S. Cl.
CPC ..... *B21J 15/323* (2013.01); *B21J 15/025* (2013.01)

(58) Field of Classification Search
CPC ..... B21J 15/323; B21J 15/025; B21J 15/02; B21J 15/10; B21J 15/12; B21J 15/32; B25C 1/003; B23P 19/001; B25B 23/045
USPC ..... 227/119, 136, 138
See application file for complete search history.

(56) References Cited

U.S. PATENT DOCUMENTS

| | | | |
|---|---|---|---|
| 1,967,056 | A | 7/1934 | Horton |
| 3,208,657 | A | 9/1965 | Cohn |
| 3,456,445 | A | 7/1969 | Bentele et al. |
| 3,543,987 | A | 12/1970 | Obergfell et al. |
| 3,920,130 | A | 11/1975 | Edgett |
| 4,015,799 | A | 4/1977 | Koski et al. |
| 4,089,009 | A | 5/1978 | Frazier |
| 4,119,258 | A | 10/1978 | Ewig, Jr. |
| 4,133,102 | A | 1/1979 | Gillemot |
| 4,319,705 | A | 3/1982 | Geist et al. |
| RE30,939 | E | 5/1982 | d'Alayer de Costemore d'Arc et al. |
| 4,404,742 | A | 9/1983 | Fuhrmeister |
| 4,410,103 | A | 10/1983 | Fuhrmeister |
| 4,615,475 | A | 10/1986 | Fuhrmeister |
| 4,716,124 | A | 12/1987 | Yerman et al. |
| 4,788,558 | A | 11/1988 | Caldwell et al. |

(Continued)

FOREIGN PATENT DOCUMENTS

| | | |
|---|---|---|
| EP | 0593970 A1 | 4/1994 |
| EP | 2498934 A1 | 9/2012 |

(Continued)

OTHER PUBLICATIONS

International Search Report and Written Opinion dated May 15, 2019 in corresponding International Application No. PCT/US2019/018906.

*Primary Examiner* — Janie M Loeppke
(74) *Attorney, Agent, or Firm* — Harness, Dickey & Pierce, PLC

(57) ABSTRACT

A receiver assembly can be coupled to a spindle to receive self-piercing rivets carried by a tape along a tape path below a punch. A reverse locking pawl can be designed to permit movement of the tape relative to the reverse locking pawl along the tape path in a forward direction and to engage a positioning aperture of the tape to stop movement of the tape in the reverse direction when a lead rivet is aligned with the punch. A method can include moving the tape forward along the tape path until a lead rivet of the tape is at a position along the tape path that is beyond an alignment position with the punch, and moving the tape in reverse to engage the corresponding positioning aperture.

23 Claims, 8 Drawing Sheets

(56) References Cited

U.S. PATENT DOCUMENTS 4,942,996 A 7/1990 Wolfberg et al.
5,032,211 A 7/1991 Shinno et al.
5,184,497 A 2/1993 Hanlon et al.
5,191,693 A * 3/1993 Umetsu ..... B23P 19/001 156/324
5,267,401 A 12/1993 Freeman et al.
5,339,983 A 8/1994 Caple
5,388,721 A 2/1995 Mauer
5,454,900 A 10/1995 Han et al.
5,542,323 A 8/1996 Habermehl et al.
5,755,519 A 5/1998 Klinefelter
5,779,127 A 7/1998 Blacket et al.
5,813,114 A 9/1998 Blacket et al.
6,089,437 A * 7/2000 Blacket ..... B21J 15/32 227/136
6,116,835 A 9/2000 Blacket et al.
6,164,489 A 12/2000 Altrock
6,266,871 B1 7/2001 Edwards
6,502,783 B1 1/2003 Smith et al.
6,536,660 B2 3/2003 Blankenship et al.
6,592,015 B1 7/2003 Gostylla et al.
6,828,743 B2 12/2004 Debuf
6,942,134 B2 9/2005 Naito
6,963,351 B2 11/2005 Squires et al.
7,131,564 B2 11/2006 Matthews et al.
7,212,637 B2 5/2007 Salisbury
7,726,598 B2 6/2010 Morelli et al.
7,896,212 B2 3/2011 Uejima et al.
8,915,460 B2 12/2014 Busch et al.
8,950,049 B2 2/2015 Williams
9,120,141 B2 * 9/2015 Clew ..... B21J 15/323
9,457,921 B2 10/2016 Barnes et al.
2004/0136768 A1 7/2004 Klinefelter et al.
2006/0266869 A1 11/2006 Quittkat
2008/0230646 A1 9/2008 Morelli et al.
2008/0251559 A1 10/2008 Uejima et al.
2013/0223956 A1 8/2013 Gostylla
2014/0000419 A1 1/2014 Park
2014/0217227 A1 8/2014 Kilibarda et al.
2014/0260831 A1 9/2014 Hays et al.
2015/0101175 A1 4/2015 Xi et al.

FOREIGN PATENT DOCUMENTS

EP 2953772 A1 12/2015
WO WO-93/01014 A1 1/1993
WO WO-96/28266 A1 9/1996
WO WO 2011/058297 A1 5/2011
WO WO-2012/046002 A2 4/2012
WO WO-2014/124007 A1 8/2014

* cited by examiner

TAPE FEED APPARATUS AND METHOD FOR A SELF-PIERCING RIVET MACHINE

FIELD

The present disclosure relates to a tape feed apparatus and method for a self-piercing rivet fastener machine.

BACKGROUND

This section provides background information related to the present disclosure which is not necessarily prior art.

Existing tape feed systems for self-piercing rivet machines typically have a ratcheting wheel between the self-piercing rivet fastener supply reel and the receiver. This ratcheting wheel typically engages holes along the tape to push the tape into the receiver. The exhausted tape leaving the receiver is typically left as a free end and allowed to fall on the floor. Cleaning up this exhausted tape can cost a surprisingly large amount of money for a manufacturer to clean up; hundreds of thousands of dollars, if not millions of dollars annually. The present disclosure relates to a tape feed apparatus and method that eliminates such clean-up costs and other disadvantages of such typical self-piercing rivet fastener tape feed systems.

SUMMARY

This section provides a general summary of the disclosure, and is not a comprehensive disclosure of its full scope or all of its features.

In accordance with one aspect of the present disclosure, a tape feed apparatus for a self-piercing rivet machine can include a supply reel, a receiver assembly, and an exhaust reel. A tape path can extend in a forward direction from the supply reel, through the receiver, and to the exhaust reel. The tape path can extend in a reverse direction from the exhaust reel, through the receiver, and to the supply reel. The receiver assembly can be coupled to an end of a self-piercing rivet spindle to receive self-piercing rivets carried by the tape along the tape path below a self-piercing rivet punch of the spindle. The receiver assembly can include a reverse locking pawl designed to permit movement of the tape along the tape path in the forward direction and to engage a corresponding one of a plurality of positioning apertures of the tape to stop movement of the tape in the reverse direction when a lead self-piercing rivet in the rivet apertures is aligned with the punch.

In accordance with one aspect of the present disclosure, a tape feed method for a self-piercing rivet machine can be provided. The self-piercing rivet machine can include a supply reel, an exhaust reel, and a receiver assembly. A tape can be movable along a tape path in a forward direction from the supply reel, through the receiver assembly, and to the exhaust reel. The tape can be movable along the tape path in a reverse direction from the exhaust reel, through the receiver assembly, and to the supply reel. The tape can have rivet apertures that carry self-piercing rivets and a rivet positioning aperture corresponding to each rivet aperture. The receiver assembly can be fixedly positioned in alignment with a self-piercing rivet punch. Such a tape feed method can include rotating the exhaust reel to move the tape in the forward direction along the tape path. Movement of the tape in the forward direction can be stopped after a lead self-piercing rivet of the tape has moved to a position along the tape path beyond an alignment position of the lead self-piercing rivet with the self-piercing rivet punch. A supply reel can be rotated to move the tape in a reverse direction along the tape path and to move the lead self-piercing rivet from the position along the tape path beyond the alignment position back toward the alignment position with the self-piercing rivet punch. Movement of the tape in the reverse direction can be stopped when the lead self-piercing rivet of the tape is positioned along the tape path in the alignment position with the self-piercing rivet punch.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
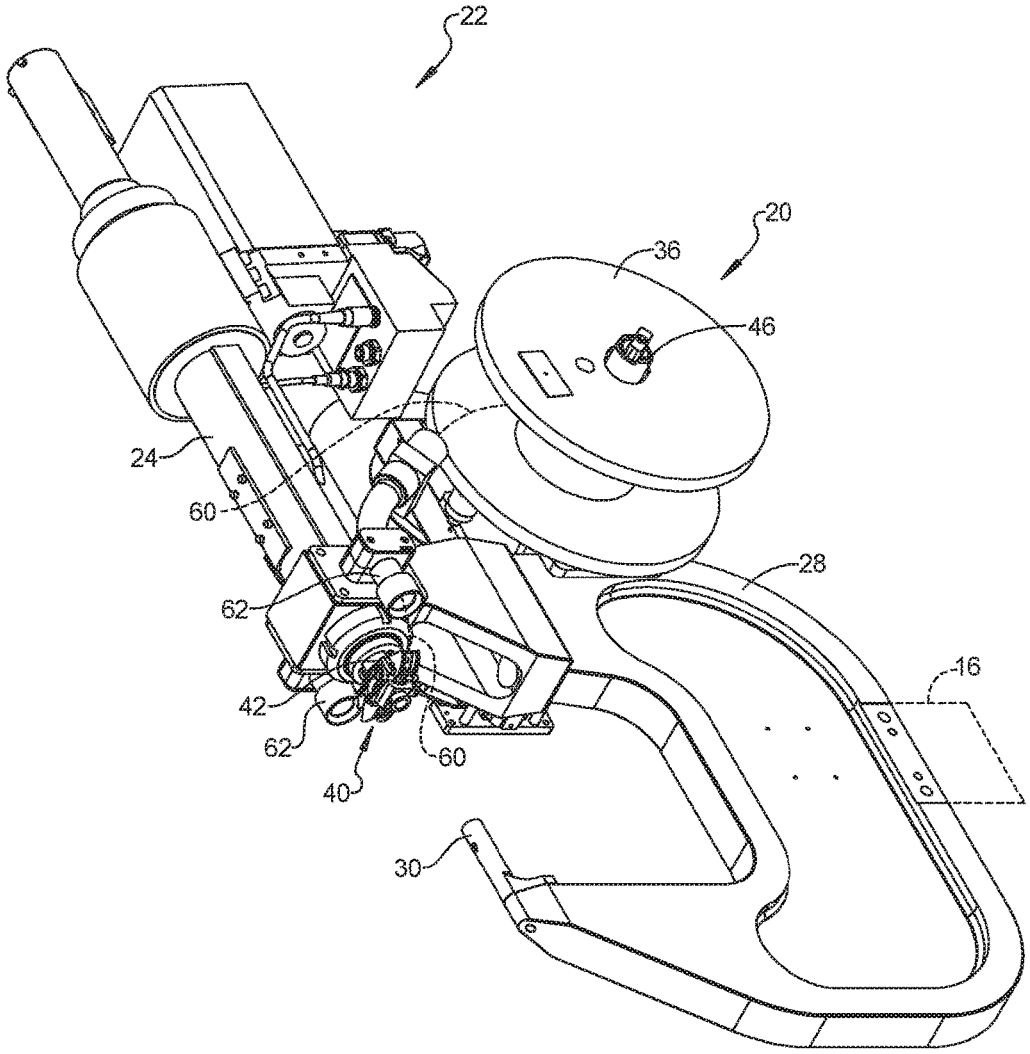
FIG. 1 is a perspective view of an example of a self-piercing rivet fastener machine including an example tape feed apparatus in accordance with the present disclosure.
Figure 2:
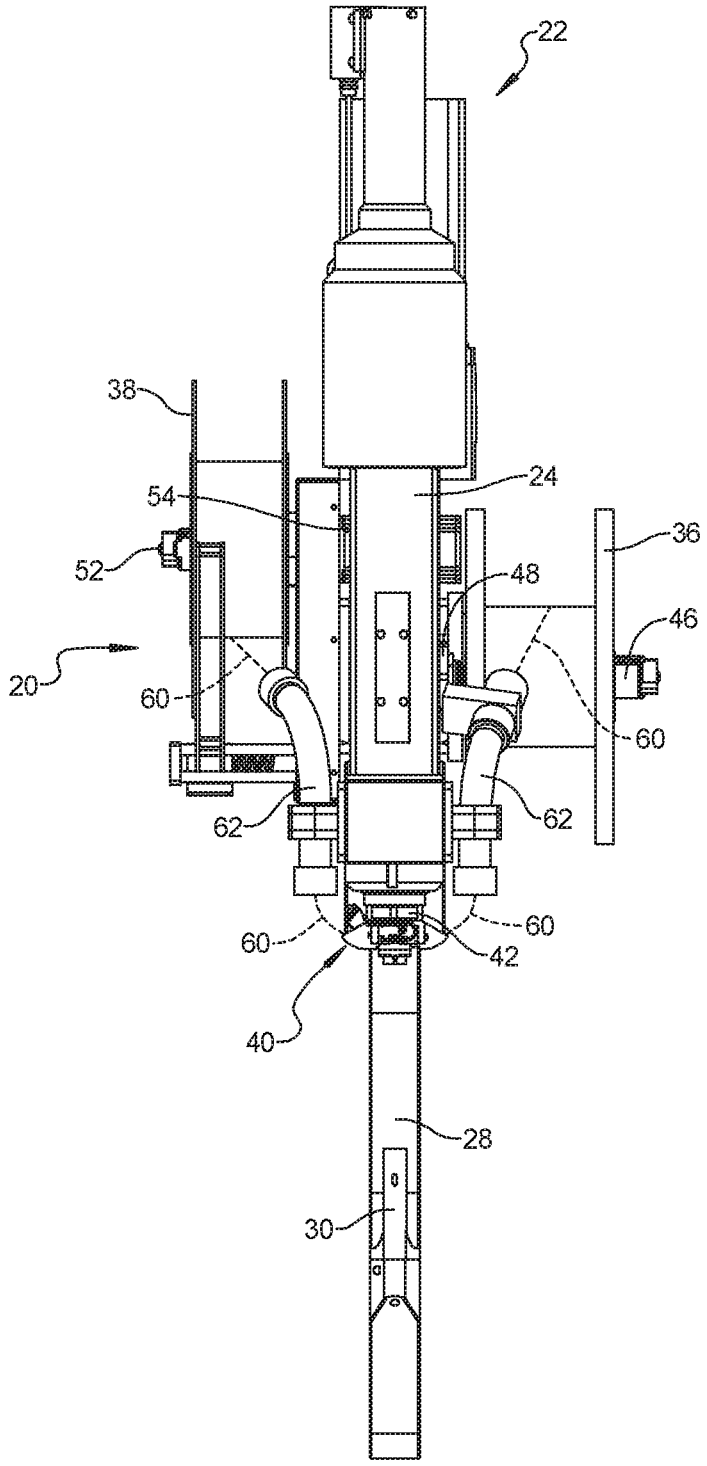
FIG. 2 is a front elevation view of the self-piercing rivet fastener machine and the tape feed apparatus of FIG. 1.
Figure 3:
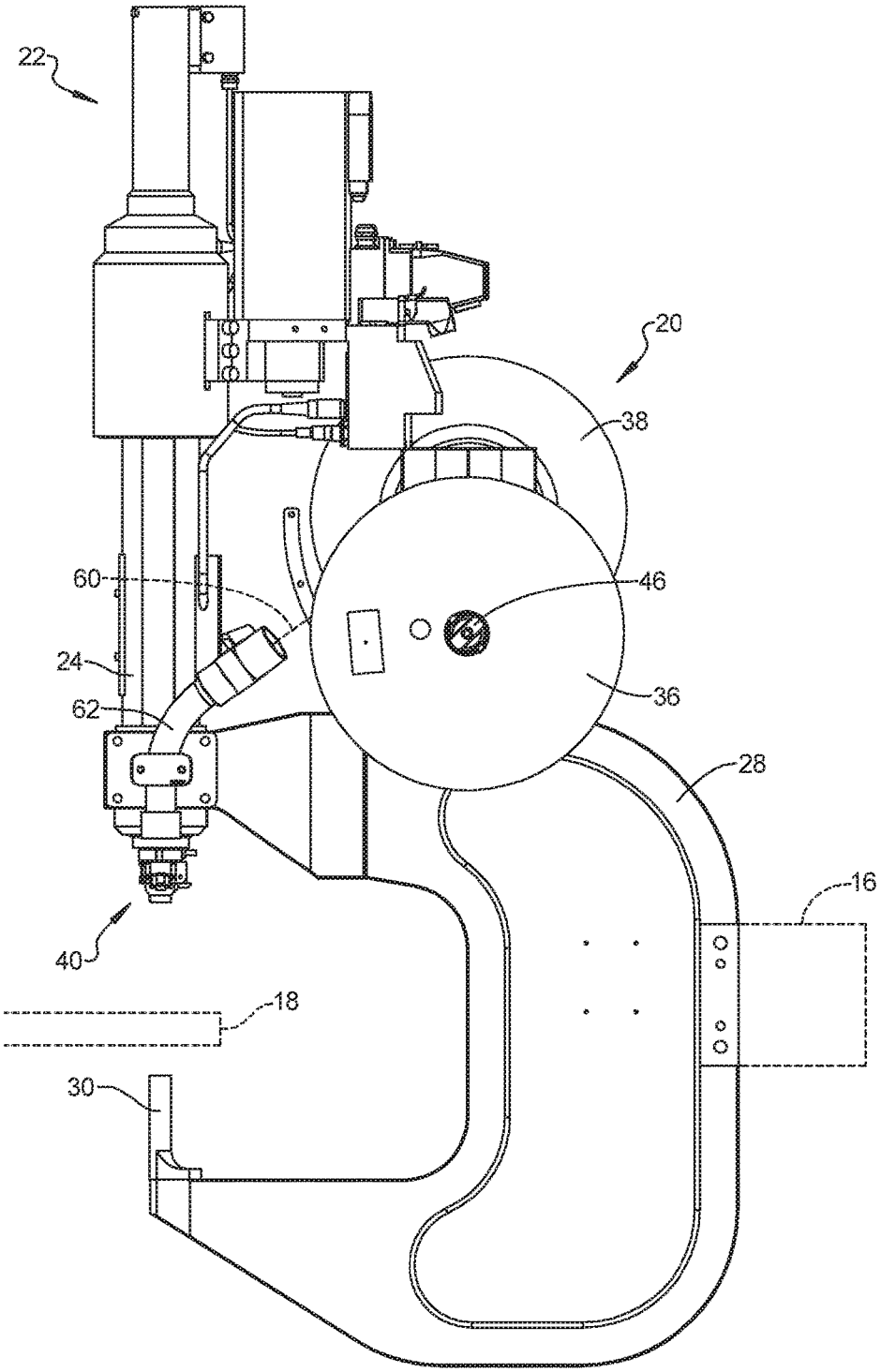
FIG. 3 is a side elevation view of the self-piercing rivet fastener machine and the tape feed apparatus of FIG. 1.
Figure 4:
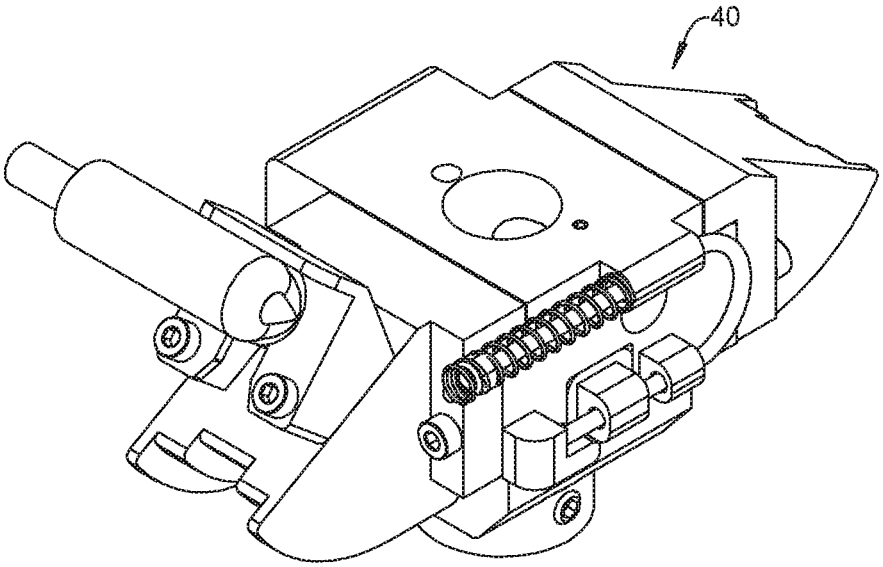
FIG. 4 is a perspective view of the receiver assembly of the tape feed apparatus of FIG. 1.
Figure 5:
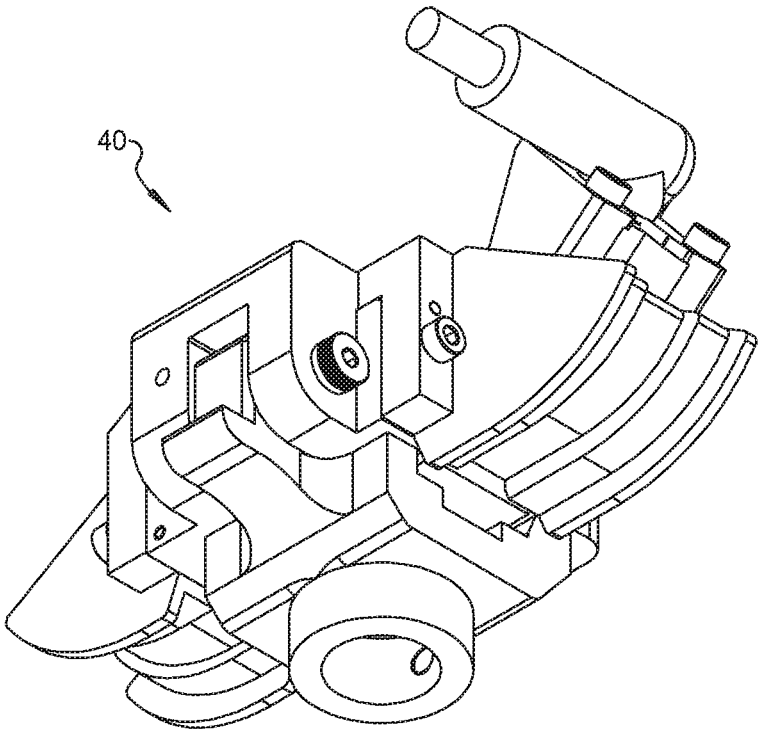
FIG. 5 is another perspective view of the receiver assembly of the tape feed apparatus of FIG. 1.
Figure 6:
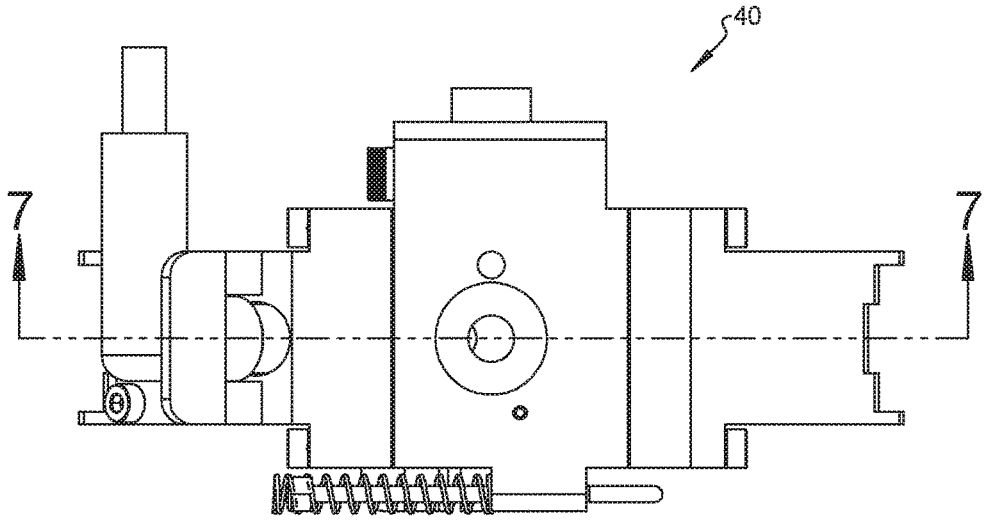
FIG. 6 is a top plan view of the receiver assembly of the tape feed apparatus of FIG. 1.
Figure 7:
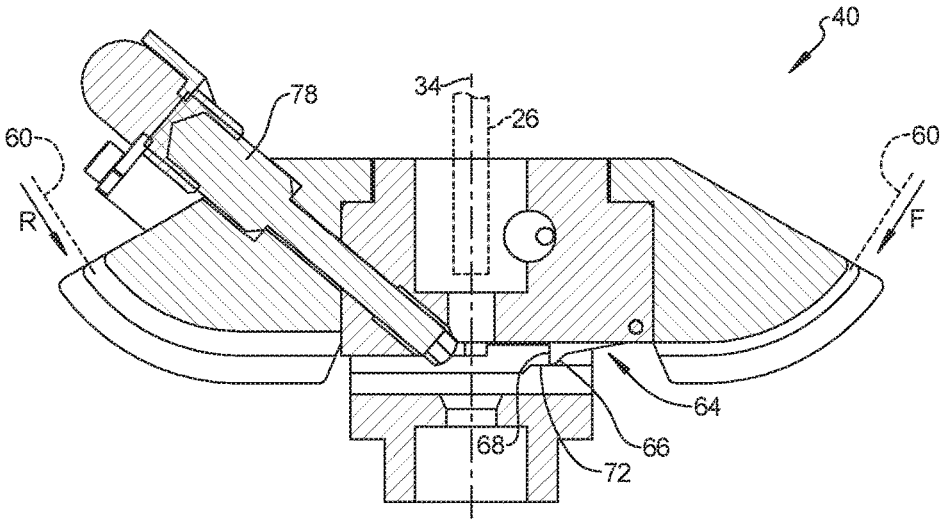
FIG. 7 is a cross section view of the receiver assembly taken along line 7-7 of FIG. 6.
Figure 8:
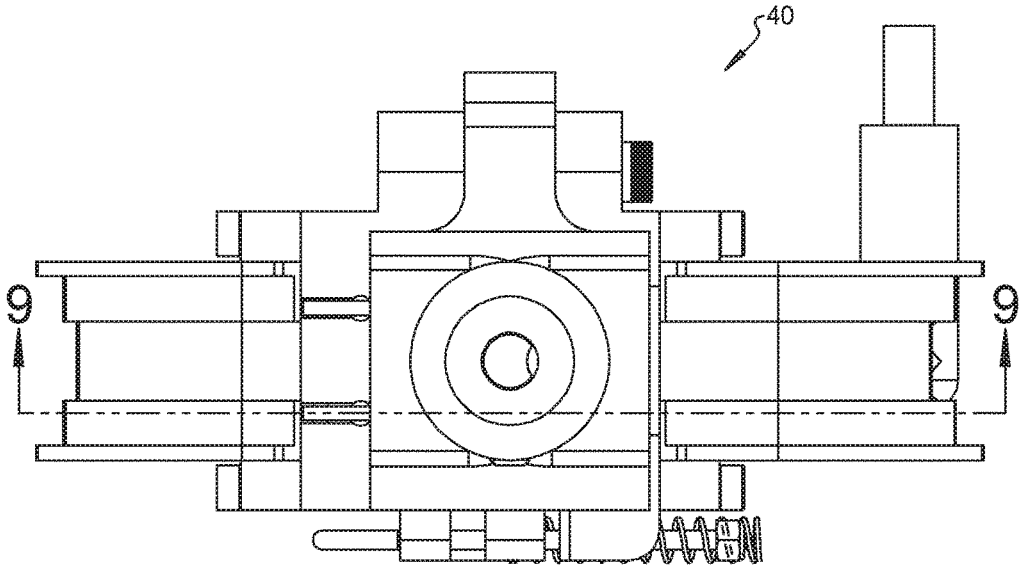
FIG. 8 is a bottom plan view of the receiver assembly of the tape feed apparatus of FIG. 1.
Figure 9:
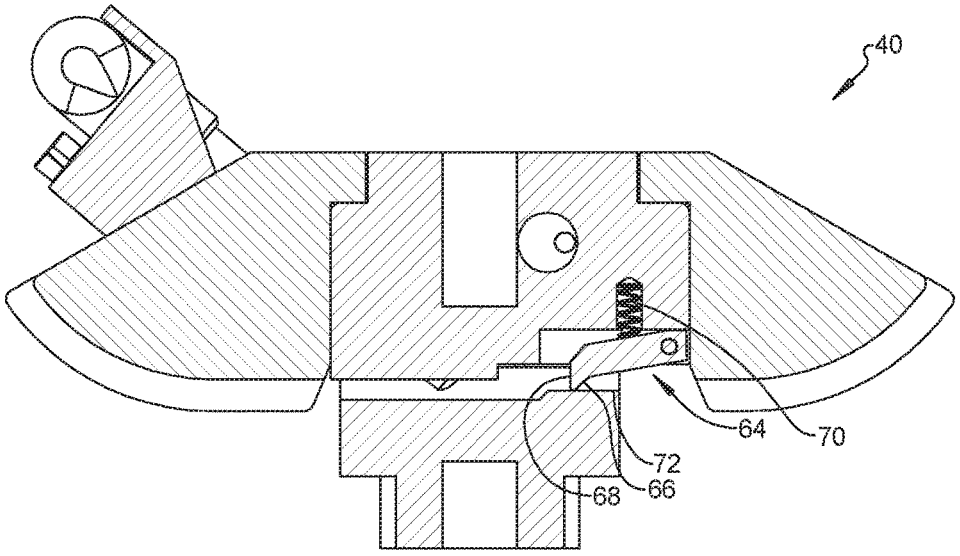
FIG. 9 is a cross section view of the receiver assembly taken along line 9-9 of FIG. 8.
Figure 10:
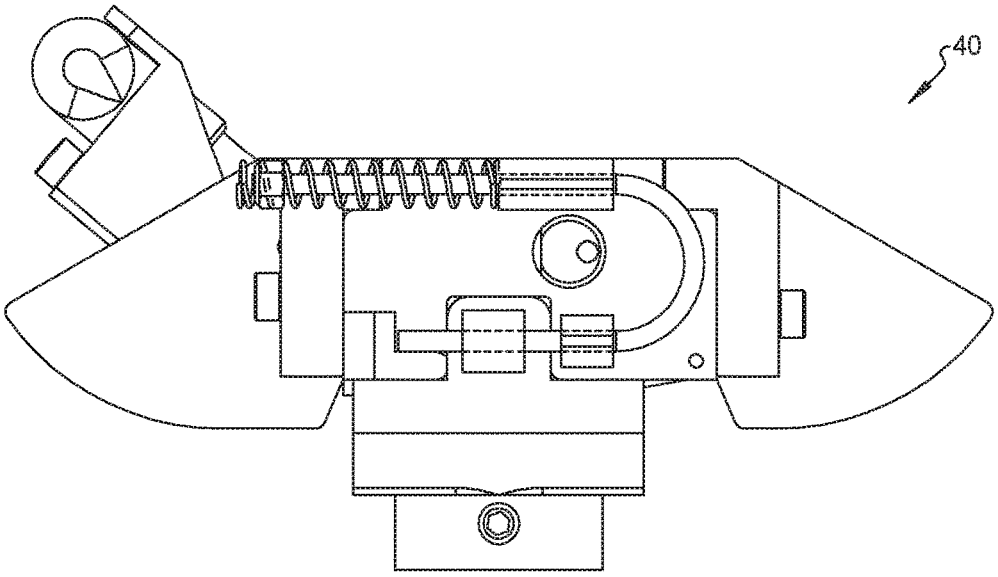
FIG. 10 is a front elevation view of the receiver assembly of the tape feed apparatus of FIG. 1.
Figure 11:
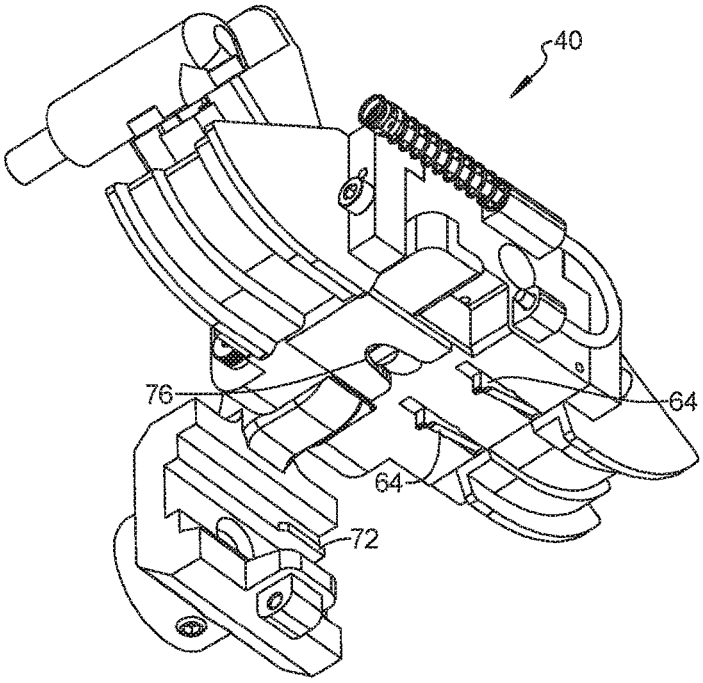
FIG. 11 is a perspective view of the receiver assembly of the tape feed apparatus of FIG. 1, with the receiver hinged into an open position.
Figure 12:
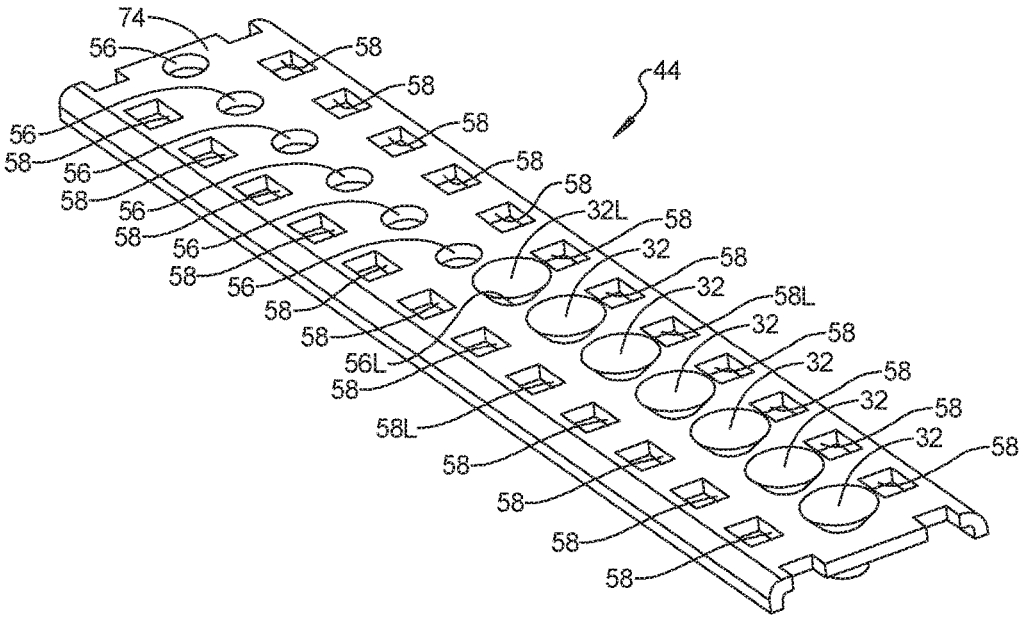
FIG. 12 is a perspective view of a self-piercing rivet carrier tape of the tape feed apparatus of FIG. 1.

With reference to FIGS. 1-12, one example of a tape feed apparatus 20 and method for a self-piercing rivet machine 22 is described below. The self-piercing rivet machine 22 can include a self-piercing rivet spindle 24 with a self-piercing rivet punch 26, and can include a C-frame 28 with a self-piercing rivet die 30. The spindle 24 can be mounted on the C-frame 28 for axial movement toward and away from the die 30. The punch 26 and the die 30 can be axially aligned with each other to cooperatively set a self-piercing rivet fastener 32 in a workpiece 18. The machine 22 can be coupled to an articulating robot arm 16 that can position the spindle 24 and die 30 in various locations and orientations relative to various workpieces.

The tape feed apparatus 20 can include a receiver assembly 40. The receiver assembly 40 can be mounted to the working or distal end 42 of the spindle 24 with the punch path 34 extending through the receiver assembly 40.

The tape feed apparatus 20 can include a supply reel 36 that can be coupled on a rivet supply side of the C-frame 28 and can include an exhaust reel 38 that can be coupled to an opposite, exhaust side of the C-frame 28. For example, the supply reel 36 can be mounted on supply reel coupling 46 that can rotate the supply reel 36 about its central axis. For example, the supply reel coupling 46 can be operably coupled to a supply servo controlled motor 48 to rotate the supply reel 36 in forward and reverse directions at variable torques. The supply reel 36 can be designed to be reusable. For example, the supply reel 36 can be made of a durable material, such as plastic, metal, or a combination thereof, so that it is reusable.

The supply reel 36 can include a fastener carrier tape 44 wound thereon. The tape 44 can have a plurality of rivet apertures 56 extending along or down the center of the tape 44. A self-piercing rivet fastener 32 can be mounted in each of the rivet apertures 56 wound on the tape 44. The tape 44 can also have a pair of positioning apertures 58 corresponding to each of the rivet apertures 56. The positioning aperture pairs 58 can extend along opposite lateral sides of the tape 44.

The exhaust reel 38 can be mounted on exhaust reel coupling 52 that can rotate the exhaust reel 38 about its central axis. For example, the exhaust reel coupling 52 can be operably coupled to an exhaust servo controlled motor 54 to rotate the exhaust reel 38 in forward and reverse directions at variable torques. The exhaust reel 38 can be designed to be disposable after a single use, and can be made of a recyclable material. For example, the exhaust reel 38 can be primarily made of a recyclable or disposable material, such as cardboard, so that it is disposable and recyclable.

A lead end of the tape 44 without self-piercing rivets 32 in the rivet apertures 56 can be coupled to the exhaust reel 38 for winding thereon. For example, any of a clip, hook, or protrusion (not shown) can be provided on the exhaust reel 38 that can engage or couple with any of the rivet apertures 56 and positioning apertures 58, that rotation of the exhaust reel 38 in forward and reverse directions facilitates winding or unwinding of the tape 44 on the exhaust reel 38.

A tape path 60 can extend in a forward direction "F" from the supply reel 36, through the receiver assembly 40, and toward or to the exhaust reel 38. The tape path 60 also extends in a reverse direction "R" from the exhaust reel 38, through the receiver assembly 40, and toward or to the supply reel 36. Intermediate tape guides 62 through which the tape 44 can pass. These Intermediate tape guides 62 can further define the tape path 60 and insure proper orientation and alignment of the tape 44 along the tape path 60. Rotation of the supply reel 36 in a corresponding reverse direction can pull the tape 44 from the exhaust reel 38 along the tape path 60 in the reverse direction "R." Similarly, rotation of the exhaust reel 38 in a corresponding forward direction pulls the tape 44 from the supply reel 36 along the tape path 60 in the forward direction "F."

The receiver assembly 40 can be designed to receive self-piercing rivets 32 carried by the tape 44 along the tape path 60 below the self-piercing rivet punch 26 of the spindle 24. The receiver assembly 40 can include a pair of reverse locking pawls 64 designed to permit movement of the tape 44 along the tape path 60 in the forward direction "F." For example, a rearward face 66 of the reverse locking pawls 64 can be angled so they will glide over the positioning apertures 58 without engaging them and stopping the tape 44 as the tape 44 moves in the forward direction. The locking pawls 64 can remain at a static pawl position along the tape path.

The reverse locking pawls 64 can also be designed to engage a corresponding pair of the positioning apertures 58 of the tape 44 to stop movement of the tape 44 in the reverse direction "R." For example, a forward face 68 of the reverse locking pawls 64 can be angled so they will engage the positioning apertures 58 and stop the tape 44 as the tape 44 moves in the reverse direction when a lead self-piercing rivet 32L in the rivet apertures 56 is aligned with the punch 26. Thus, this engagement of the reverse locking pawls 64 with the positioning apertures 58 includes a coupling or locking between the two features, which stops movement of the tape in the reverse direction to stop.

Application of a position retention supply torque to the supply reel 36 in the corresponding reverse direction can then maintain the coupling or locking between the reverse locking pawls 64 and the corresponding positioning apertures 58L, to keep the lead self-piercing rivet 32L aligned with the punch 26 and punch path 34. Simultaneous or concurrent application of an position retention exhaust torque to the exhaust reel 38 in the corresponding forward direction that is less than the position retention supply torque can further aid in insuring accurate positioning and alignment of the lead self-piercing rivet 32L with the punch 26 and punch path 34. While the lead self-piercing rivet 32L is aligned with the punch 26 and punch path 34, the spindle 24 can be activated, driving the punch 26, which in turn drives the lead self-piercing rivet 32L from the lead rivet aperture 56L and into the workpiece sandwiched between the receiver assembly 40 and the die 30.

The reverse locking pawls 64 can be pivotably mounted for movement between a retracted and an extended position. A biasing member 70 such as a spring, can be provided to bias the reverse locking pawls 64 toward the extended position. The receiver assembly 40 can include a tape support or positioning surface 72 adjacent the reverse locking pawls 64 that is designed to insure proper positioning of the tape 44 relative to the locking pawls 64 to provide the intended interaction therebetween. Thus, the reverse locking pawls 64 can be is positioned by the receiver assembly 40 to contact and slide along an opposing tape surface 74, such as the upper surface, of the tape 44. In addition, the receiver assembly 40 can support the opposing surface 74 of the tape 44 in a position relative to the reverse locking pawls 64 that the surface 74 can engage the reverse locking pawls 64 to push them against the biasing member toward their retracted positions.

The receiver assembly 40 can include a hard rivet stop 76 positioned to engage the lead self-piercing rivet 32L to stop movement of the tape 44 in the forward direction. The hard rivet stop 76 can be spaced from the reverse locking pawls 64 at a distance from the reverse locking pawls 64 that insures the reverse locking pawls 64 engage the corresponding pair of positioning apertures 58L to stop movement of the tape 44 in the reverse direction when the lead self-piercing rivet 32L in the rivet apertures 56 is aligned with the rivet punch 26 and the punch path 34. As just one example, the corresponding pair of positioning apertures 58L can be two reverse positioning apertures 58 in the reverse direction from the rivet aperture 56L holding the lead rivet 32L.

The receiver assembly 40 can include a rivet sensor 78 positioned to detect a presence of the lead self-piercing rivet 32L when it is within the receiver assembly 40 adjacent the rivet stop 76. For example, the rivet sensor 78 can be positioned to detect the presence of the lead self-piercing rivet 32L when this rivet is at a distance from the reverse locking pawls 64 that insures that they engage the corresponding positioning apertures 58L to stop movement of the tape 44 in the reverse direction when the lead self-piercing rivet 32L is aligned with the rivet punch 26 and the punch path 34. The rivet sensor 78 can in some cases be an induction sensor. In other cases, the rivet sensor 78 can be a magnetic sensor or a vision sensor.

Example methods related to a tape feed apparatus 20 in accordance with this disclosure can include rotating the exhaust reel 38 in a corresponding forward direction to move the tape 44 in the forward direction along the tape path 60. This rotating the exhaust reel 38 in the corresponding forward direction to move the tape 44 in the forward direction along the tape path 60 can include applying a forward torque to the exhaust reel 38. A reverse counter-torque that is less than the forward torque can be simultaneously or concurrently applied to the supply reel 36 while this forward torque is being applied to the exhaust reel 38 to help minimize problematic slack in the tape 44.

This movement of the tape 44 along the tape path 60 in the forward direction can be stopped after a lead self-piercing rivet 32L of the tape has moved to a position along the tape path 60 that is beyond, past, or forward of an alignment position of the lead self-piercing rivet 32L with the self-piercing rivet punch 26 and punch path 34. This stopping of the movement of the tape 44 in the forward direction can include ceasing the rotation of the exhaust reel 38 in the corresponding forward direction, which can include ceasing the application of the forward torque to the exhaust reel 38.

This stopping of the movement of the tape 44 in the forward direction can include engaging or contacting the lead self-piercing rivet 32L against the fixed physical or hard rivet stop 76 of the receiver assembly 40 that is at or adjacent the position along the tape path 60 that is beyond, past or forward of the alignment position along the tape path 60. In addition, this stopping of the movement of the tape 44 in the forward direction can include engaging or contacting the lead self-piercing rivet 32L against the fixed physical or hard rivet stop 76, which is spaced from the reverse locking pawls 64 at a distance from the reverse locking pawls 64 that insures the reverse locking pawls 64 engage the corresponding pair of positioning apertures 58L during the movement of the lead self-piercing rivet 32L from the position along the tape path 60 that is beyond, past, or forward of the alignment position back toward the alignment position.

This stopping of the movement of the tape 44 in the forward direction can alternatively or additionally include the rivet sensor 78 detecting the presence of the lead self-piercing rivet 32L when it is at or adjacent the position along the tape path 60 that is beyond, past, or forward of the alignment position along the tape path 60. In addition, this stopping of the movement of the tape 44 in the forward direction can include detecting the presence of the lead self-piercing rivet 32L with the rivet sensor 78 when the lead self-piercing rivet 32L is at sensed location that is or adjacent the position beyond, past, or forward of the alignment position, and which sensed location is spaced from the reverse locking pawls 64 at a distance from the reverse locking pawls 64 that insures the reverse locking pawls 64 engage the corresponding pair of positioning apertures 58L during the movement of the lead self-piercing rivet 32L from the position along the tape path 60 that is beyond, past or forward of the alignment position back toward the alignment position.

The supply reel 36 can be rotated in a corresponding reverse direction to move the tape 44 in the reverse direction along the tape path 60 and to move the lead self-piercing rivet 32L from the position along the tape path beyond, past, or forward of the alignment position back toward the alignment position with the self-piercing rivet punch 26 and punch path 34. This rotating of the supply reel 36 in the corresponding reverse direction to move the tape 44 in the reverse direction along the tape path 60 can include applying a reverse torque to the supply reel 36. A forward counter-torque that is less than the reverse torque can be simultaneously or concurrently applied to the exhaust reel 38 while this reverse torque is being applied to the supply reel 36 to help minimize problematic slack in the tape 44.

This movement of the tape 44 along the tape path 60 in the reverse direction can be stopped when the lead self-piercing rivet 32L of the tape 44 is positioned along the tape path 60 in the alignment position with the self-piercing rivet punch 26 and punch path 34. This stopping of the movement of the tape 44 in the reverse direction along the tape path 60 comprises engaging reverse locking pawls 64 of the receiver assembly 40 with rivet positioning apertures 58L that correspond to the lead rivet aperture 56L carrying the lead self-piercing rivet 32L.

A position retention supply torque can be applied to the supply reel 36 in the corresponding reverse direction to maintain the coupling or locking between the reverse locking pawls 64 and the corresponding positioning apertures 58L, to keep the lead self-piercing rivet 32L aligned with the punch 26 and punch path 34. In some cases, the position retention supply torque can have the same magnitude to that of the reverse torque being applied to the supply reel 36. In other cases, the position retention supply torque can have a magnitude that is less than, or greater than that of the reverse torque being applied to the supply reel 36.

A position retention exhaust torque can be simultaneously or concurrently applied to the exhaust reel 38 in the corresponding forward direction simultaneously or concurrently with the position retention supply torque being applied to the supply reel 36. This position retention exhaust torque can be less than the position retention supply torque to further aid in insuring accurate positioning and alignment of the lead self-piercing rivet 32L with the punch 26 and punch path 34. In some cases, the position retention exhaust torque can have the same magnitude to that of the forward counter-torque being applied to the exhaust reel 38. In other cases, the position retention exhaust torque can have a magnitude that is less than, or greater than that of the forward counter-torque being applied to the exhaust reel 38.

While the lead self-piercing rivet 32L is aligned with the punch 26 and punch path 34, the spindle 24 can be activated, driving the punch 26, which in turn drives the lead self-piercing rivet 32L from the lead rivet aperture 56L and into the workpiece sandwiched between the receiver assembly 40 and the die 30.

The foregoing description of example embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

In addition, it will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A tape feed apparatus for a self-piercing rivet machine comprising:

a supply reel, a receiver assembly, and an exhaust reel;

a tape path extending in a forward direction from the supply reel, through the receiver, and to the exhaust reel, and the tape path extending in a reverse direction from the exhaust reel, through the receiver, and to the supply reel;

a tape extending along the tape path, the tape having rivet apertures designed to carry self-piercing rivets and a rivet positioning aperture corresponding to each rivet aperture;

the receiver assembly being coupled to an end of a self-piercing rivet spindle to receive self-piercing rivets carried by the tape along the tape path below a self-piercing rivet punch of the spindle;

the receiver assembly including a reverse locking pawl designed to permit movement of the tape along the tape path in the forward direction and to bring a lead self-piercing rivet into a position of alignment with the self-piercing rivet punch by engaging the corresponding rivet positioning aperture of the tape to stop movement of the tape in the reverse direction as the lead self-piercing rivet in the rivet apertures comes into the position of alignment with the self-piercing rivet punch from the reverse direction; and a two-directional tape indexing system designed to move the tape in the forward direction causing the lead self-piercing rivet to move into an overalignment position on the tape path in which the lead self-piercing rivet is beyond the position of alignment with the self-piercing rivet punch in the forward direction, and to move the tape in the reverse direction causing the lead self-piercing rivet to move from the overalignment position into the position of alignment with the self-piercing rivet punch from the reverse direction.

2. The tape feed apparatus of claim 1, wherein the reverse locking pawl is shaped to pass over the positioning apertures of the tape as the tape is moved in the forward direction, and to engage with the positioning apertures of the tape as the tape is moved in the reverse direction to stop movement of the tape in the reverse direction.

3. The tape feed apparatus of claim 2, wherein the reverse locking pawl is positioned to contact and slide along a surface of the tape.

4. The tape feed apparatus of claim 1, wherein the reverse locking pawl is moveable between a retracted position in which the reverse locking pawl is not engaged with the positioning apertures and an extended position in which the reverse locking pawl is engaged with one of the positioning apertures to stop movement of the tape in the reverse direction.

5. The tape feed apparatus of claim 4, wherein a biasing member biases the reverse locking pawl toward the extended position.

6. The tape feed apparatus of claim 5, wherein the receiver assembly supports a surface of the tape in a position relative to the reverse locking pawl that retains the reverse locking pawl in the retracted position against the biasing member during movement of the tape in the forward direction.

7. The tape feed apparatus of claim 1, wherein the receiver assembly includes a rivet stop positioned to engage the lead self-piercing rivet to stop movement of the tape in the forward direction, and the rivet stop being spaced from the reverse locking pawl at a distance from the reverse locking pawl that insures the reverse locking pawl engages the corresponding one of the plurality of positioning apertures to stop movement of the tape in the reverse direction as the lead self-piercing rivet in the rivet apertures comes into the position of alignment with the punch from the reverse direction.

8. The tape feed apparatus of claim 7, wherein the receiver assembly includes a rivet sensor positioned to detect a presence of the lead self-piercing rivet adjacent the rivet stop.

9. The tape feed apparatus of claim 1, wherein the receiver assembly includes a rivet sensor positioned to detect a presence of the lead self-piercing rivet when the rivet is at a distance from the reverse locking pawl that insures the reverse locking pawl engages the corresponding one of the plurality of positioning apertures to stop movement of the tape in the reverse direction as the lead self-piercing rivet in the rivet apertures comes into the position of alignment with the punch from the reverse direction.

10. The tape feed apparatus of claim 1, wherein the two-directional tape indexing system is designed to rotate the supply reel in a corresponding reverse direction causing the tape to be pulled from the exhaust reel along the tape path in the reverse direction.

11. The tape feed apparatus of claim 10, wherein the two-directional tape indexing system is designed to rotate the exhaust reel in a corresponding forward direction causing the tape to be pulled from the supply reel along the tape path in the forward direction.

12. The tape feed apparatus of claim 1, wherein the receiver assembly includes a second reverse locking pawl designed to permit movement of the tape along the tape path in the forward direction and to engage a corresponding one of a second plurality of positioning apertures of the tape to stop movement of the tape in the reverse direction as a lead self-piercing rivet in the rivet apertures comes into the position of alignment with the punch from the reverse directional.

13. The tape feed apparatus of claim 1, wherein the two-directional tape indexing system comprises a supply servo controlled motor coupled to the supply reel and an exhaust servo controlled motor coupled to the exhaust reel.

14. The tape feed apparatus of claim 1, wherein the locking pawl that engages the corresponding rivet positioning aperture is positioned in the reverse direction along the tape path from the position of alignment with the punch.

15. The tape feed apparatus of claim 1, wherein the locking pawl that engages the corresponding rivet positioning aperture is positioned above the tape path to engage the corresponding rivet positioning aperture from an upper surface of the tape.

16. A tape feed apparatus for a self-piercing rivet machine comprising:

a supply reel, a receiver assembly, and an exhaust reel;

a tape path extending in a forward direction from the supply reel, through the receiver, and to the exhaust reel, and the tape path extending in a reverse direction from the exhaust reel, through the receiver, and to the supply reel;

a tape extending along the tape path, the tape having rivet apertures designed to carry self-piercing rivets and a rivet positioning aperture corresponding to each rivet aperture;

the receiver assembly being coupled to an end of a self-piercing rivet spindle to receive self-piercing rivets carried by the tape along the tape path below a self-piercing rivet punch of the spindle;

the receiver assembly including a reverse locking pawl designed to permit movement of the tape along the tape path in the forward direction and to bring a lead self-piercing rivet into a position of alignment with the self-piercing rivet punch by engaging the corresponding rivet positioning aperture of the tape to stop movement of the tape in the reverse direction as the lead self-piercing rivet in the rivet apertures comes into the position of alignment with the self-piercing rivet punch from the reverse direction; and at least one motor coupled to the supply reel and the exhaust reel and designed to rotate the supply reel and the exhaust reel to move the tape in the forward direction causing the lead self-piercing rivet to move into an overalignment position on the tape path in which the lead self-piercing rivet is beyond the position of alignment with the self-piercing rivet punch in the forward direction, and to move the tape in the reverse direction causing the lead self-piercing rivet to move from the overalignment position into the position of alignment with the self-piercing rivet punch from the reverse direction.

17. The tape feed apparatus of claim 16, wherein the at least one motor comprises at least one servo controlled motor.

18. The tape feed apparatus of claim 16, wherein the at least one motor comprises a supply motor coupled to the supply reel and an exhaust motor coupled to the exhaust reel.

19. The tape feed apparatus of claim 16, wherein the at least one motor comprises a supply servo controlled motor coupled to the supply reel and an exhaust servo controlled motor coupled to the exhaust reel.

20. The tape feed apparatus of claim 16, wherein the at least one motor is designed to rotate the supply reel in a corresponding reverse direction causing the tape to be pulled from the exhaust reel along the tape path in the reverse direction.

21. The tape feed apparatus of claim 20, wherein the at least one motor is designed to rotate the exhaust reel in a corresponding forward direction causing the tape to be pulled from the supply reel along the tape path in the forward direction.

22. The tape feed apparatus of claim 16, wherein the locking pawl that engages the corresponding rivet positioning aperture is positioned in the reverse direction along the tape path from the position of alignment with the punch.

23. The tape feed apparatus of claim 16, wherein the locking pawl that engages the corresponding rivet positioning aperture is positioned above the tape path to engage the corresponding rivet positioning aperture from an upper surface of the tape.

* * * * *